US006854621B2

(12) United States Patent
Keller

(10) Patent No.: US 6,854,621 B2
(45) Date of Patent: Feb. 15, 2005

(54) CARTRIDGE DISPENSER INCLUDING DRIVE FOR DYNAMIC MIXER

(75) Inventor: Wilhelm A. Keller, Merlischachen (CH)

(73) Assignee: Mixpac Systems AG, Rotkreuz (CH)

( * ) Notice: Subject to any disclaimer, the term of this patent is extended or adjusted under 35 U.S.C. 154(b) by 11 days.

(21) Appl. No.: 10/217,514

(22) Filed: Aug. 14, 2002

(65) Prior Publication Data

US 2002/0190082 A1 Dec. 19, 2002

Related U.S. Application Data

(63) Continuation of application No. 09/616,931, filed on Jul. 14, 2000, now Pat. No. 6,457,609.

(30) Foreign Application Priority Data

Jul. 29, 1999 (EP) ..... 99810686
Apr. 19, 2000 (EP) ..... 00810344

(51) Int. Cl.[7] ..... B67D 5/052

(52) U.S. Cl. ..... 222/137; 222/145.6; 222/333; 222/390

(58) Field of Search ..... 222/137, 145.6, 222/325, 326, 327, 386, 333, 390

(56) References Cited

U.S. PATENT DOCUMENTS 3,051,455 A 8/1962 Magester
3,226,093 A 12/1965 Gugel et al.
3,302,832 A * 2/1967 Hardman et al. ..... 222/94
3,390,814 A 7/1968 Creighton, Jr. et al.
3,570,719 A * 3/1971 Schiff ..... 222/137
3,587,982 A 6/1971 Campbell
3,767,085 A 10/1973 Cannon et al.
4,107,793 A 8/1978 Wallace
4,432,469 A 2/1984 Eble et al.
4,471,888 A 9/1984 Herb et al.
4,767,025 A 8/1988 Gebauer et al.
4,934,827 A * 6/1990 Taschke et al. ..... 366/162.3

(List continued on next page.)

FOREIGN PATENT DOCUMENTS

DE 3233366 9/1983
DE 4235736 3/1994

(List continued on next page.)

*Primary Examiner*—Gene Mancene
*Assistant Examiner*—Melvin A. Cartagena
(74) *Attorney, Agent, or Firm*—Foley & Lardner LLP

(57) ABSTRACT

The cartridge dispenser comprises a double cartridge having two cylindrical containers of different cross-sections, a drive for a dynamic mixer, and a housing base in which the drive shaft of the dynamic mixer is arranged in a longitudinally displaceable manner. The mixer drive shaft is guided in a laterally displaceable manner such that the driver of the mixer drive shaft is situated on the center axis of the mixer rotor independently of the cross-sectional ratio of the containers of the double cartridge. The mixer is located on the center axis which extends between the outlets of the containers. The mixer drive shaft is automatically forced to the correct position when a double cartridge is inserted. Consequently, the driver is always correctly aligned to the mixer rotor. Suitable means in the housing base always provide a correct location of the cartridges, and in a preferred embodiment, the mixer can be attached to the cartridge without the need of being previously oriented.

7 Claims, 7 Drawing Sheets

U.S. PATENT DOCUMENTS

| | | | | | |
|---|---|---|---|---|---|
| 4,951,843 | A | | 8/1990 | Paetow | |
| 4,981,241 | A | | 1/1991 | Keller | |
| 4,986,443 | A | | 1/1991 | Saur et al. | |
| 5,249,709 | A | * | 10/1993 | Duckworth et al. | 222/137 |
| 5,249,862 | A | | 10/1993 | Herold et al. | |
| 5,263,614 | A | * | 11/1993 | Jacobsen et al. | 222/137 |
| 5,286,105 | A | | 2/1994 | Herold et al. | |
| 5,400,925 | A | * | 3/1995 | Simmen | 222/137 |
| 5,411,180 | A | * | 5/1995 | Dumelle | 222/137 |
| 6,129,244 | A | * | 10/2000 | Horth | 222/94 |
| 6,135,631 | A | | 10/2000 | Keller | |
| 6,161,730 | A | | 12/2000 | Heusser et al. | |
| 6,168,052 | B1 | | 1/2001 | Keller | |
| 6,186,363 | B1 | | 2/2001 | Keller et al. | |
| 6,244,740 | B1 | | 6/2001 | Wagner et al. | |
| 6,290,101 | B1 | * | 9/2001 | Chang | 222/137 |
| 6,311,871 | B1 | * | 11/2001 | Binder | 222/145.6 |
| 6,394,643 | B1 | | 5/2002 | Bublewitz et al. | |
| 6,443,612 | B1 | | 9/2002 | Keller | |
| 6,457,609 | B1 | | 10/2002 | Keller | |
| 6,523,992 | B1 | * | 2/2003 | Bublewitz et al. | 366/172.1 |
| 6,530,685 | B1 | | 3/2003 | Muhlbauer et al. | |
| 2002/0175186 | A1 | | 11/2002 | Keller | |
| 2003/0123323 | A1 | | 7/2003 | Bublewitz et al. | |
| 2003/0137898 | A1 | | 7/2003 | Wagner et al. | |

FOREIGN PATENT DOCUMENTS

| | | |
|---|---|---|
| DE | 33 07 558 | 9/1994 |
| DE | 29705741 | 9/1998 |
| EP | 0 057 465 | 8/1982 |
| EP | 0087029 | 8/1983 |
| EP | 0492412 | 12/1991 |
| EP | 0 492 413 | 11/1994 |
| EP | 0 956 908 | 11/1994 |
| EP | 1110599 | 6/2001 |
| EP | 1149627 | 10/2001 |
| WO | WO 98/43727 | 10/1998 |
| WO | WO 00/21652 | 4/2000 |
| WO | WO 01/24919 | 4/2001 |
| WO | WO 02/074426 | 9/2002 |

* cited by examiner

CARTRIDGE DISPENSER INCLUDING DRIVE FOR DYNAMIC MIXER

CROSS-REFERENCE TO RELATED APPLICATIONS

This application is a continuation of U.S. application Ser. No. 09/616,931 now U.S. Pat. No. 6,457,609, file on Jul. 14, 2000, the disclosure of which is incorporated herein in its entirety. This application further claims the benefit of and priority to European Application No. 99 810 686.8 filed on Jul. 29, 1999, and European Application No. 00 810 344.2 filed on Apr. 19, 2000.

FIELD OF THE INVENTION

The present invention refers to a cartridge dispenser comprising a double cartridge with two containers of equal or different cross-sectional areas, a drive for a dynamic mixer, and a housing base in which the drive shaft of the mixer is arranged in a longitudinally displaceable manner.

It refers also to a cartridge dispenser comprising a double cartridge with two containers of equal or different cross-sectional areas, a drive for a dynamic mixer, and a housing base in which the double cartridge is arranged, and further to a dispensing or metering appliance comprising two containers of equal or different cross-sectional areas and a mixer, more particularly a dynamic mixer.

BACKGROUND OF THE INVENTION

A dispenser for a predetermined dispensing ratio is disclosed in European Patent No. 492,413, according to which the drive shaft of the mixer is manually displaceable in the axial direction in order to couple or uncouple the mixer. U.S. Pat. No. 4,981,241 discloses an appliance allowing to dispense cartridges of different dispensing ratios and accordingly of variable cartridge diameters in one and the same dispenser, which is only designed for static mixers, however.

SUMMARY OF THE INVENTION

On the background of this prior art, it is a first object of the present invention to provide a double cartridge dispenser for dynamic mixers where the drive of the dynamic mixer operates with any combination of double cartridges of different dispensing ratios resp. container cross-sections. This object is attained by a dispenser wherein the mixer drive shaft is displaceably guided in such a manner that the tongue end of the mixer drive shaft is situated on the center axis of the mixer rotor independently of the cross-sectional ratio of the containers of the double cartridge.

A further object of the invention is to allow double cartridges having equal or different container cross-sections in a large range of e.g. 1:1 to 10:1 to be used in one and the same dispenser. This object is attained by a dispenser wherein locating means in the housing base and/or locating means on the double cartridges allow correct retaining positions of double cartridges having containers of different cross-sectional ratios of preferably 1:1 to 10:1.

A further object of the invention is to allow a mixer to be connected to one and the same dispensing or metering appliance comprising containers of equal or different cross-sections independently of its orientation with respect to the containers.

Further characteristic features and advantages are defined in the dependent claims.

BRIEF DESCRIPTION OF THE DRAWINGS

The invention will be explained in more detail hereinafter with reference to drawings of exemplary embodiments.

DETAILED DESCRIPTION OF THE INVENTION

Figure 1:
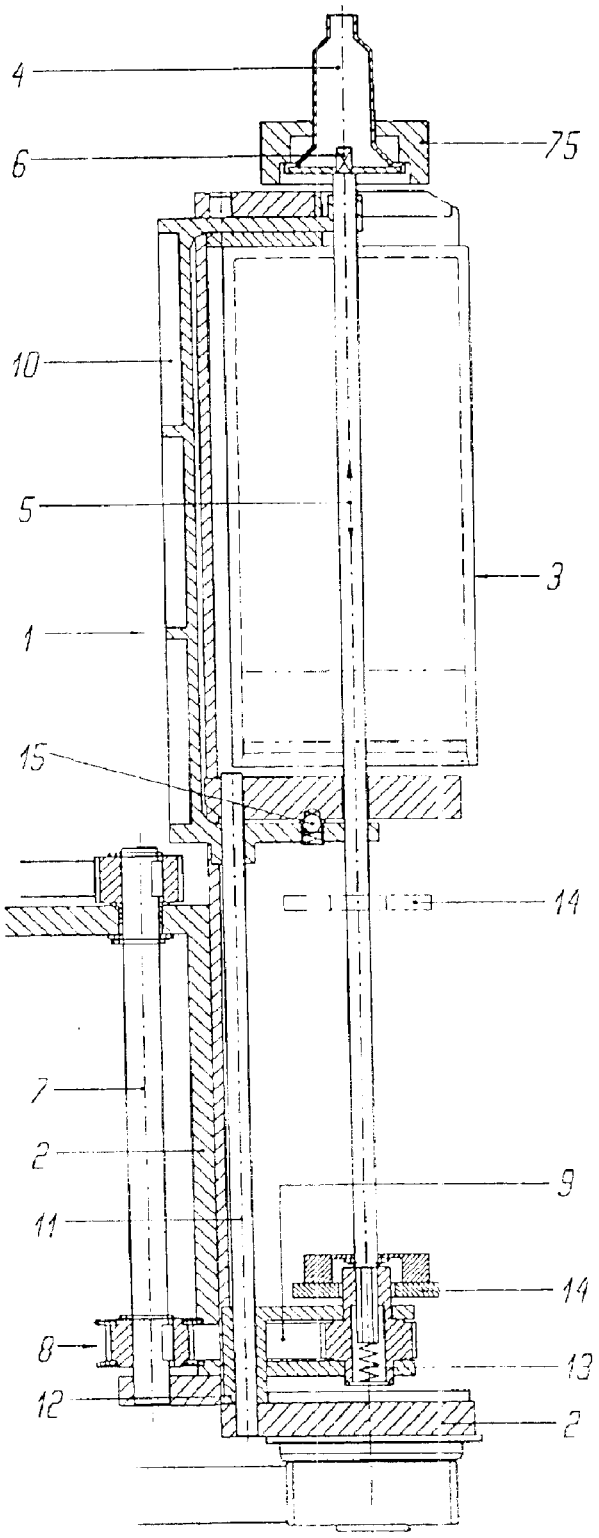
FIG. 1 shows a longitudinal section of an embodiment of the invention.

FIG. 1 shows those elements which are important for the actuation of the mixer while the remaining parts, more particularly the drive of the dispensing plungers and their disposition in the housing, may be realized e.g. according to European Patent Publication No. 956,908.

FIG. 1 shows dispenser 1 with housing base 2, double cartridge 3, dynamic mixer 4, and drive shaft 5 with tongue end 6 for the dynamic mixer. In order to ensure a minimum flow distance of the components, the mixer is located on the connecting line between the outlets of the cartridge containers and between the prolongation of the outlets respectively between the imaginary prolongation of the cartridge containers. Although this is the most advantageous position of the mixer, small deviations therefrom are also possible. It follows that the position of the mixer with respect to the housing base and to the axes of the dispensing plungers varies according to the cross-sectional ratio of the cartridge containers.

The rotor of dynamic mixer 4 is driven by a non-represented electric drive which actuates mixer drive shaft 5 via drive shaft 7, gear wheels 8, and a toothed belt 9. The mixer drive shaft is pivotable on a yoke 10 having multiple bearings and on a pivoting lever 12 turning on the same axle 11. Furthermore, the mixer is fastened to the cartridge outlet by a bayonet ring 75 which may also be a screw ring.

On the drive side, the mixer drive shaft is supported on a compression spring 13 and thereby kept in engagement with the rotor of the dynamic mixer. At the end of the return stroke, the mixer shaft may e.g. be manually retracted from the mixer according to European Patent No. 492,413, or automatically, as in the present example, by a connection 14 moving with the slide.

As will be described in more detail below, when double cartridges of different cross-sectional ratios are inserted after having exchanged the cartridge positioning guide strips, the mixer drive shaft is automatically pivoted to the correct position due to the curvature of the cartridge cylinders and fixed in detents 15, and the dispenser is ready for use as the dynamic mixer is attached.

Figure 2:
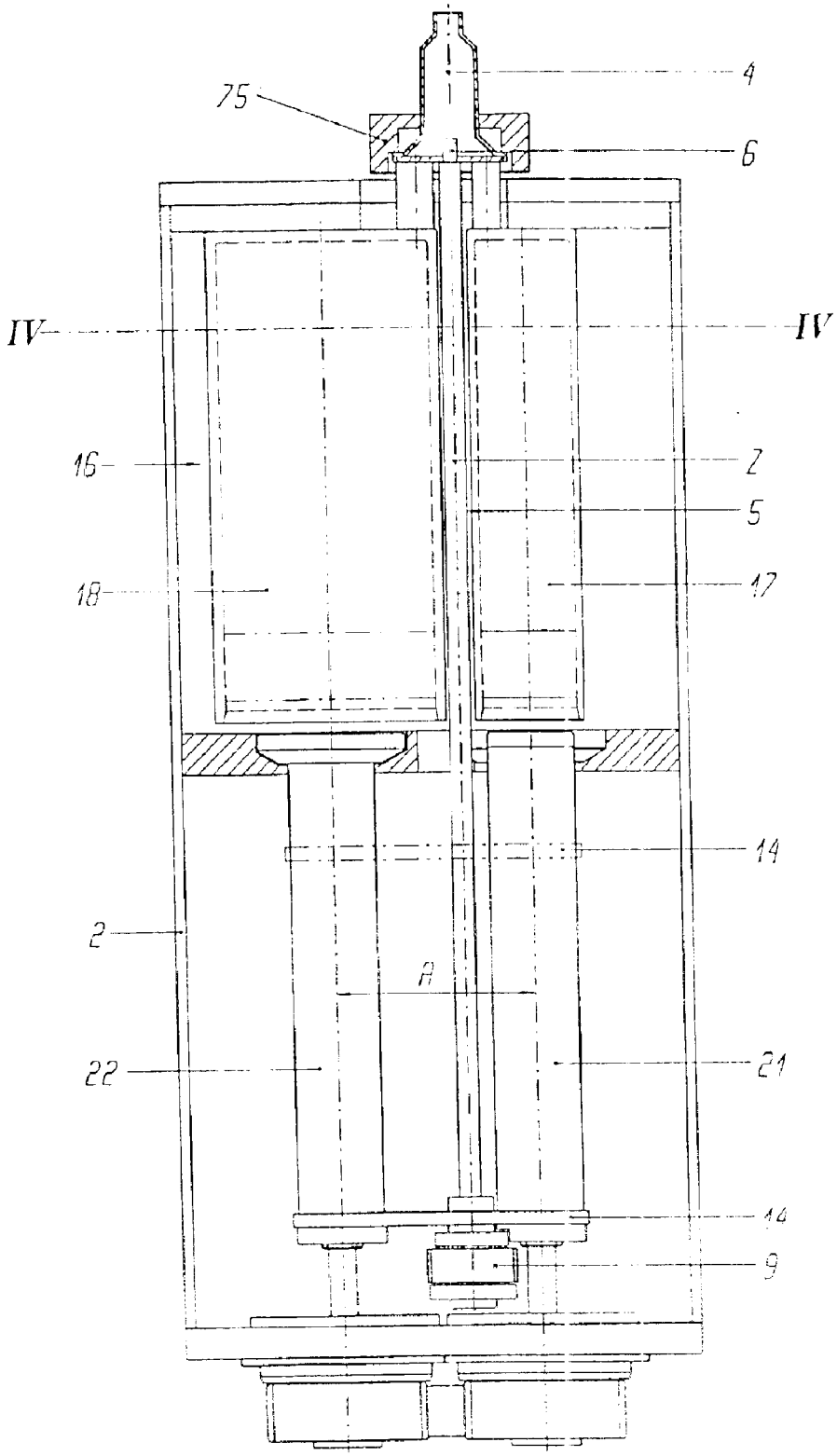
FIG. 2 shows the embodiment of FIG. 1 in a top view.
Figure 3:
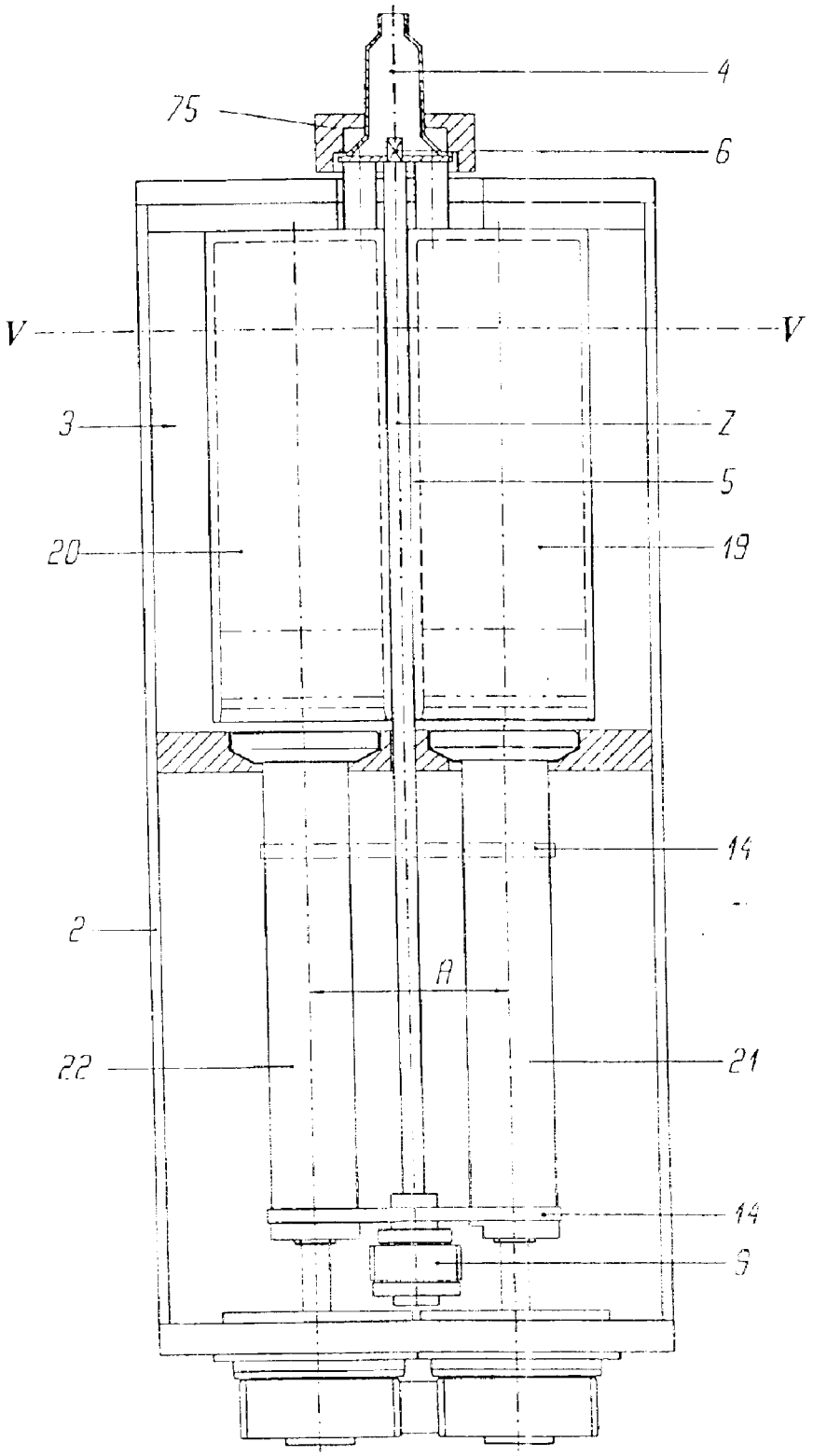
FIG. 3 shows an embodiment similar to FIG. 2, however with a double cartridge having equal cross-sections.

FIGS. 2 and 3 show the dispenser of FIG. 1 in a top view, and according to FIG. 2, a double cartridge 16 having two cylindrical containers 17 and 18 is inserted whose cross-sectional areas correspond to a ratio of 5:1. In FIG. 3, the same housing base 2 holds the double cartridge 3 of FIG. 1 which comprises equal containers 19 and 20 having a cross-sectional ratio of 1:1. The comparison of FIGS. 2 and 3 shows that on one hand, the distance A between the axes of the two dispensing plungers 21 and 22 is the same for all double cartridges in spite of different cross-sectional ratios while the end position of drive shaft 5 of the tongue end thereof varies according to the actual cross-sectional ratio. In the present embodiment, the displacement is provided by a pivoting movement in parallel to the longitudinal axes of the containers while the two end positions of the tongue end are located, in accordance with the center axis Z of the mixer or of the rotor, on the connecting line between the container outlets, as appears especially in FIGS. 4 and 5.

However, it is also possible instead of a pivoting movement to displace the mixer shaft by means of a parallel guidance, especially if more than two different double cartridges are used, or to provide a flexible mixer drive shaft, which also allows a displacement of the tongue end. However, the displacement of the drive shaft is always effected such that in its end position, the tongue end is located on the center axis Z of the mixer rotor in order to ensure a correct driving action.

If the same dispenser 1 is to be used for double cartridges having different cross-sections, i.e. different geometrical dimensions, it follows that the double cartridge and the dynamic mixer must be aligned to the plungers and to the mixer drive shaft. According to the invention, the exact guidance and positioning of the cartridges and thus also of the dynamic mixer in one and the same dispenser and housing base is obtained by the application of a cartridge tray having exchangeable guide strips which are adapted to the different diameters of the cartridge containers and are inserted in the cartridge tray, or by locating means which are provided on the cartridges.

Figure 4:
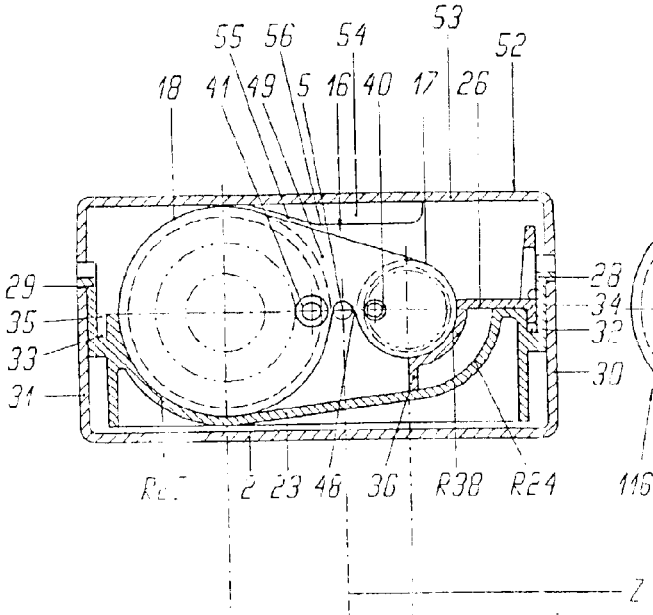
FIG. 4 shows a cross-section according to line IV—IV in FIG. 2.
Figure 5:
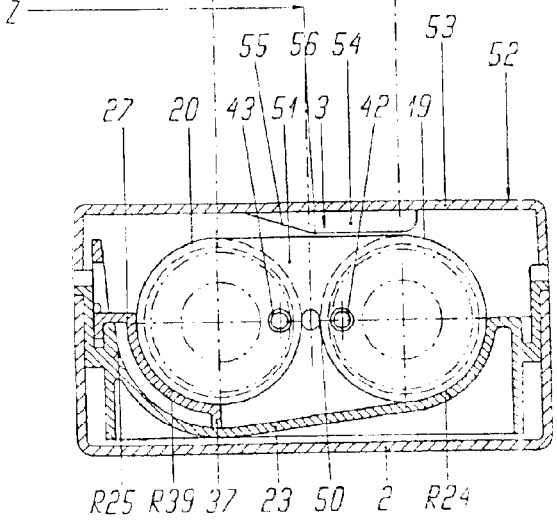
FIG. 5 shows a cross-section according to line V—V in FIG. 3.

In the present examples according to FIGS. 4 and 5, two double cartridges having cross-sectional ratios of 5:1 and 1:1 are described, but it is understood that the same applies to other cross-sectional ratios e.g. from 1:1 to 10:1. When comparing FIGS. 4 and 5, it appears that cartridge tray 23 on one of the sides, i.e. in this case on the right side, has a curvature radius R24 which corresponds to the curvature of container 19, i.e. of 1:1 cartridge 3, and that curvature radius R25 on the left side of the cartridge tray corresponds to the larger container 18 of double cartridge 16.

It follows that in all of the above-mentioned cross-sectional ratios, one container of the double cartridge is directly supported on the cartridge tray. The respective other container, in this case 17 or 20, rests on a guide strip 26 or 27 respectively which is supported on the cartridge tray.

The cartridge tray is supported on the walls 30 and 31 of housing base 2 by two arms 28 and 29, the cartridge tray comprising two longitudinal grooves 32, 33 in which corresponding shanks 34 and 35 of the guide strip engage. These shanks are so designed or coded that the guide strips cannot be inserted in the wrong position. The second shank 36 and 37 of guide strip 26 and 27 respectively rests on the curved portion of the cartridge tray. It is understood that the curvature radii R38 and R39 of the guide strips are the same as those of the containers they are intended to receive, i.e. in this case 17 and 20.

Dispenser 1 further comprises a housing cover 52 whose upper wall 53 is internally provided with an aligning rib 54 which is disposed in the center area and comprises a sloped portion 55 and a horizontal portion 56. These two portions serve the purpose of holding down and aligning either the connecting flange 49 of 5:1 cartridge 16, 116, or 216, see FIG. 4 or 9, or connecting flange 51 of the 1:1 cartridge, see FIG. 5 or 11.

Instead of using guide strips, it is also possible to provide corresponding spacers on the cartridges. Such alternatives are illustrated in FIGS. 6 to 11, the spacers being arranged on the container walls and/or on the outlets or on the flanges.

Figure 6:
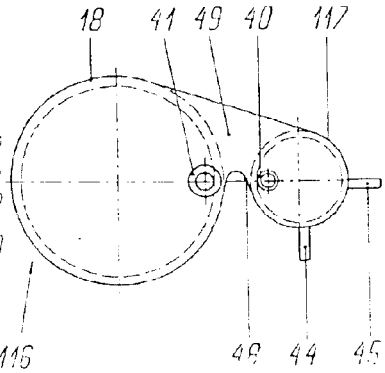
FIG. 6 shows a top view of an alternative embodiment of the cartridge of FIG. 4.

In FIG. 6, double cartridge 116 corresponds to double cartridge 16 of FIG. 4 and comprises the two containers 117 and 18. Larger container 18 is the same as in FIG. 4, while the wall of container 117 of smaller diameter comprises two spacers 44 and 45 which are intended to rest on cartridge tray 23 and correspond to guide strip 26. It is also possible to provide spacers on the container having the larger diameter.

Figure 7:
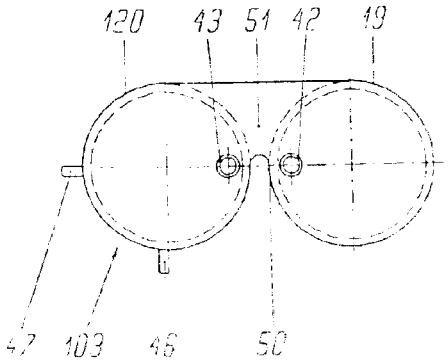
FIG. 7 shows a top view of an alternative embodiment of the cartridge of FIG. 5.

In FIG. 7, double cartridge 103, which corresponds to double cartridge 3 of FIG. 5, includes two identical containers 19 and 120, the wall of container 120 comprising two spacers 46 and 47 which correspond to guide strip 27 and are intended to rest on cartridge tray 23. If the cartridge tray is differently designed, e.g. for more than two different cartridges, it is also possible to provide spacers on both containers.

FIGS. 4–7 further show and double cartridge 16, 116 with outlets 40 and 41, e.g. of different outlet diameters, as well as double cartridge 3, 103 with the two outlets 42 and 43 of the same diameter, and mixer drive shaft 5. When comparing FIGS. 4 and 5, it appears that the axis of drive shaft 5 is displaced as it is always located between the two cartridge containers, i.e. between the two outlets. The mixer and therefore also the tongue end lie on an axis Z which is situated on the connecting line of the two outlets and between the imaginary prolongation of the two containers. In the present example, the outlets lie on the connecting line between the two container center axis.

In FIGS. 8, 9 and 10, 11, it is shown that the cartridge may also be held in the dispenser by supporting it on the housing base in such a manner that the cartridge containers are always inserted and maintained in the correct position independently of the ratio of their sizes.

Figure 8:
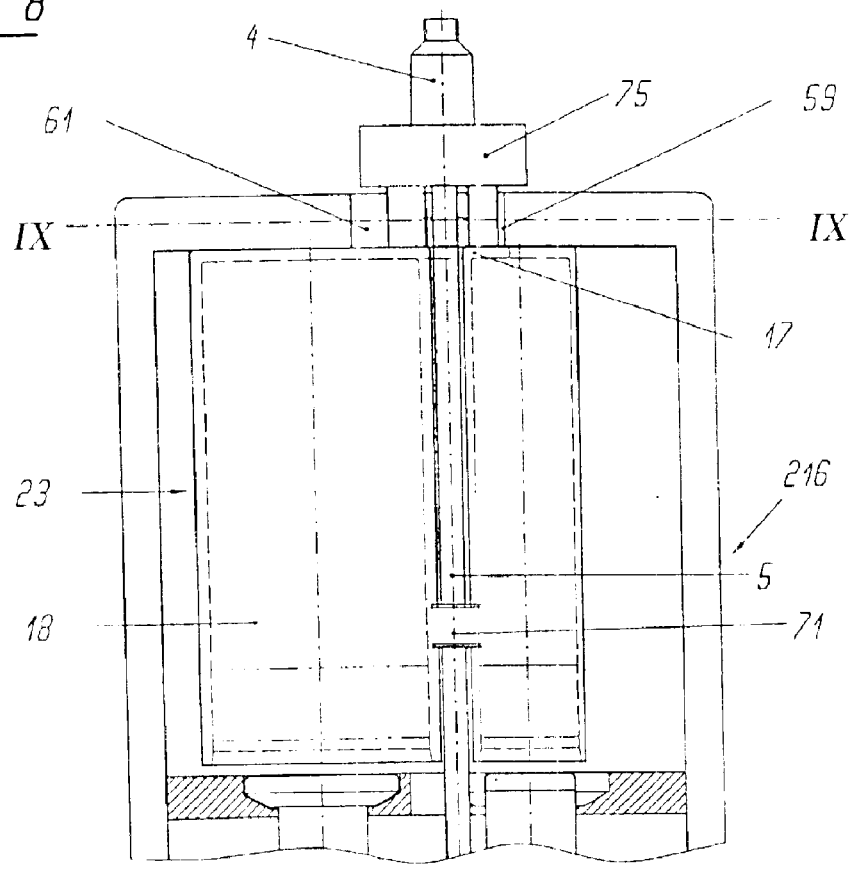
FIG. 8 shows a top view of another alternative embodiment of the cartridge of FIG. 4.
Figure 9:
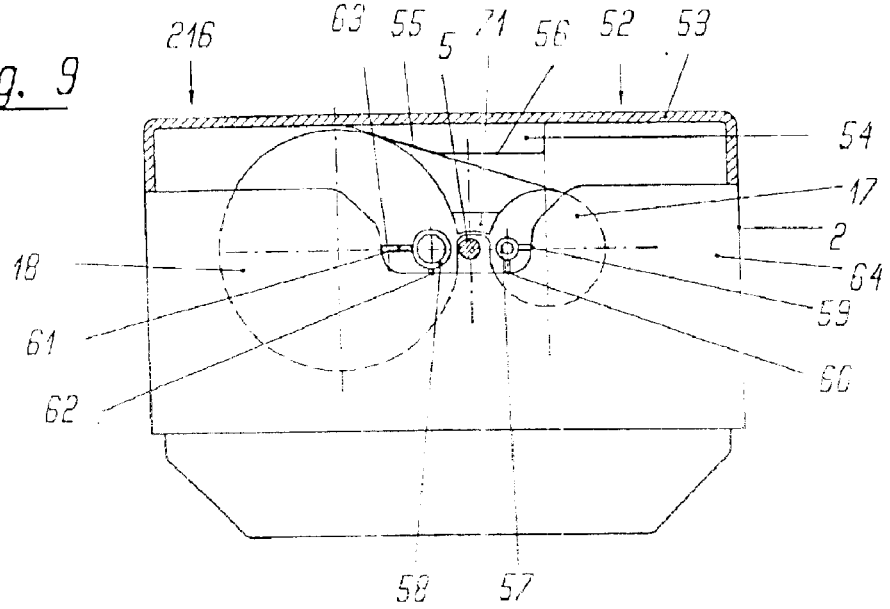
FIG. 9 shows a cross-section according to line IX—IX in FIG. 8.

In FIGS. 8 and 9, a 5:1 cartridge inserted in the dispenser is illustrated similarly to FIGS. 2 and 4. The cartridge includes two containers 17 and 18. Container 17 comprises an outlet 57 and container 18 an outlet 58, outlet 57 being provided with spacers 59, 60 and outlet 58 with spacers 61, 62 whose function is similar to that of spacers 44–47. Spacers 59–62 rest on a recess 63 in wall 64 of housing base 2 facing the mixer, and their dimensions are adapted to the recess. A crosspiece 71 is arranged in the area on the plunger side of the cartridge, which is so designed that the cartridge is supported on mixer drive shaft 5.

Figure 10:
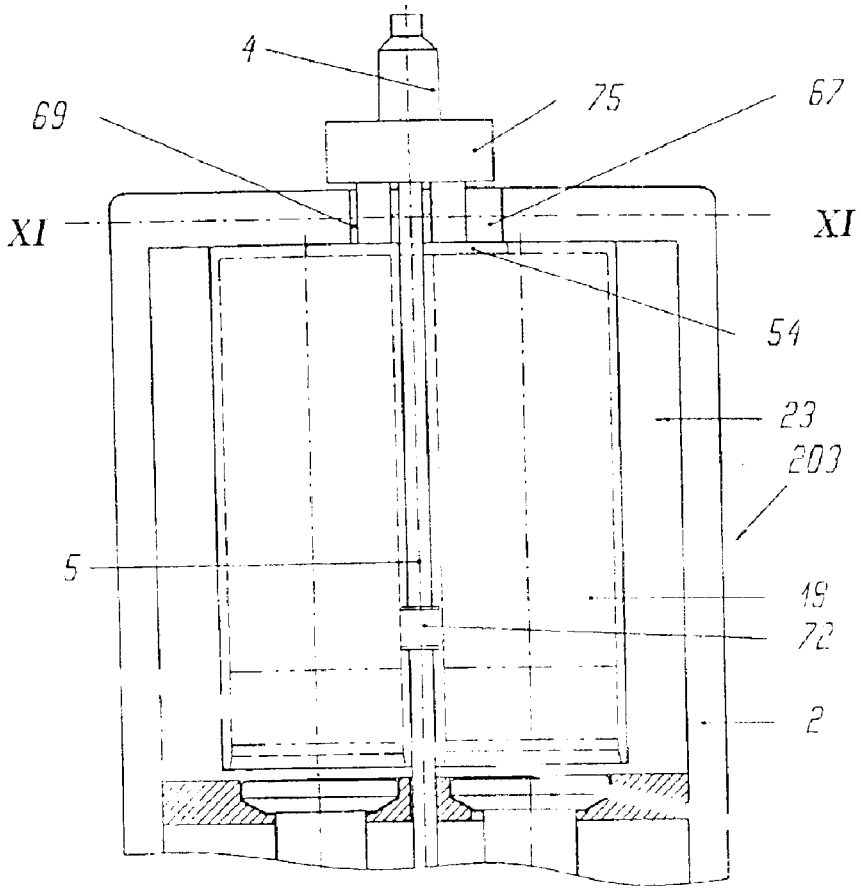
FIG. 10 shows a top view of another alternative embodiment of the cartridge of FIG. 4.
Figure 11:
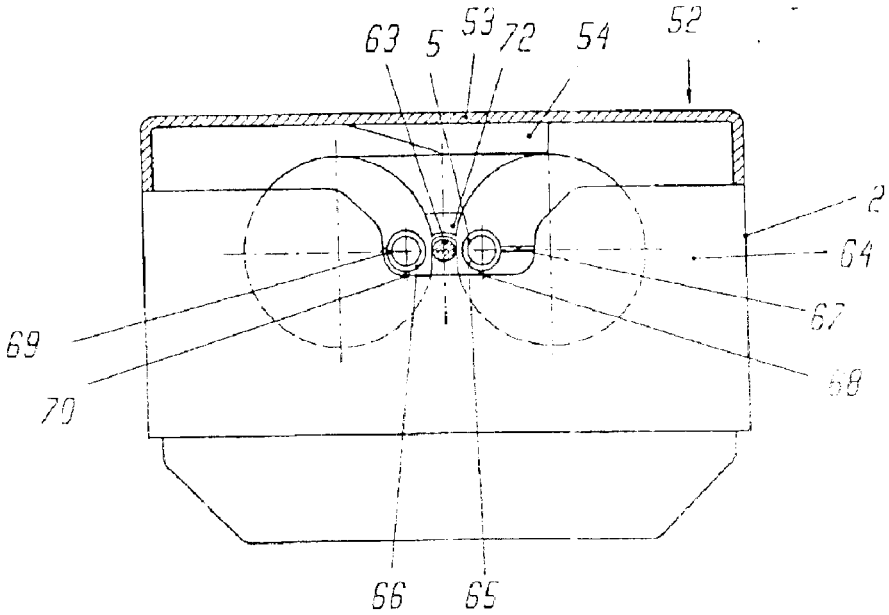
FIG. 11 shows a cross-section according to line XI—XI in FIG. 10.

In analogy to FIGS. 8 and 9, an inserted 1:1 cartridge is illustrated in FIGS. 10 and 11. Cartridge 203 includes the two containers 19 and 20 with outlets 65 and 66. The outlets are provided with spacers 67, 68 resp. 69, 70 which rest on recess 63. The cartridge further comprises crosspiece 72.

In the embodiments according to FIGS. 6–11, the cartridge tray is not necessary for supporting the cartridges and in this case only serves as a collecting basin.

Figure 12:
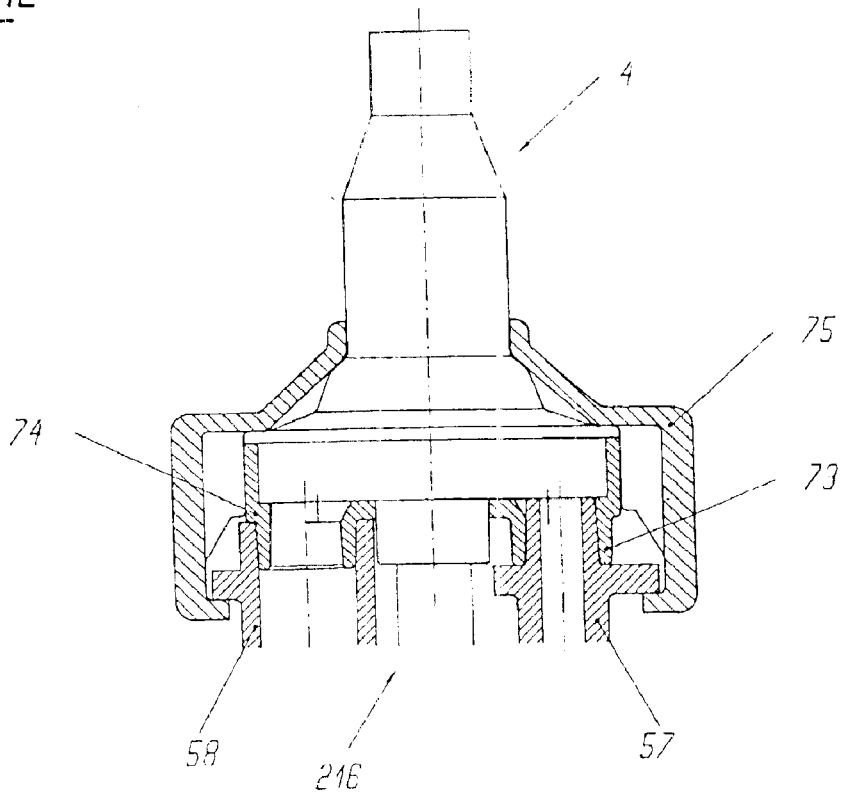
FIG. 12 shows a cross-sectional view of the connection of a mixer to a 5:1 cartridge.
Figure 13:
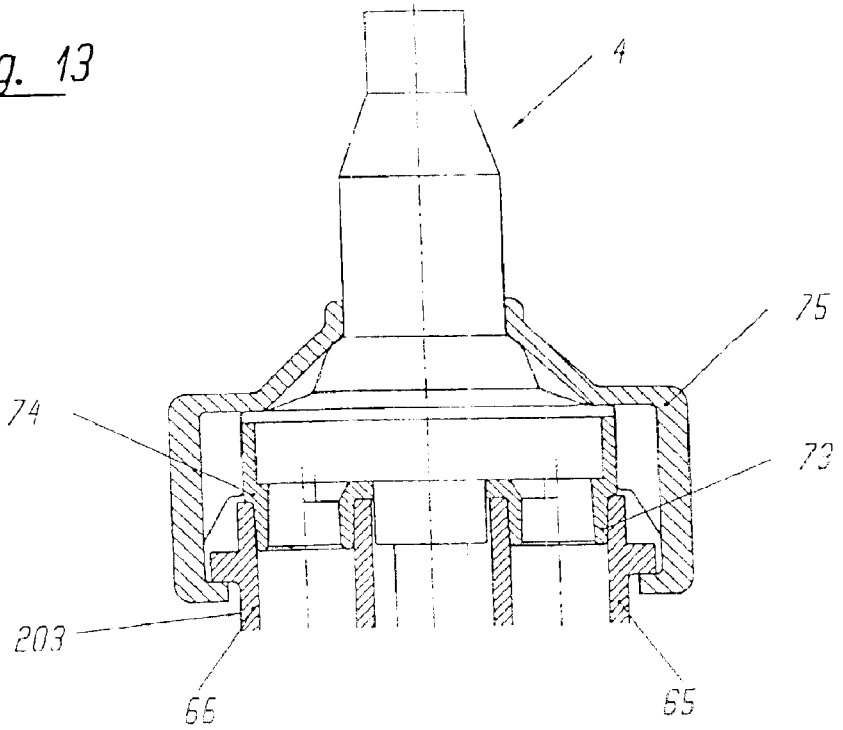
FIG. 13 shows a cross-sectional view of the connection of a mixer to a 1:1 cartridge.

In the cross-sections of FIGS. 12 and 13, it appears that the inlets 73 and 74 of mixer 4 have equal dimensions while in the case of cartridges having a ratio other than 1:1, outlets 40, 57 of containers 17, 117 of smaller cross-section have a smaller diameter than outlets 41, 58 of containers 18 of larger cross-section. The different dimensioning of the outlets serves as an adaptation to the different mixing ratios.

The diameters of the cartridge outlets are so dimensioned that the inlets of the mixer are either always insertable into the outlets of the containers of 1:1 cartridges, or that one of the inlets is insertable into the outlet of the container of larger cross-section and the other inlet is capable of being slid on the outlet of the container of smaller cross-section. In this manner, the mixer can be attached to any suitable cartridge or to any suitable metering or dispensing appliance in one position or another rotated by 180°, i.e. without the need of previously orienting it. Moreover, this combination of mixer inlets and dispenser outlets is not limited to dynamic mixers.

If a change of the dispensing ratio requires a lateral displacement of the mixer shaft, this is automatically effected due to the shape of the containers of the newly inserted cartridge, the mixer shaft being simultaneously fixed in one of detents 15. The displacement is ensured by the wedge action of one of the walls of each container. A recess 48, 50 in the connecting flange 49, 51 on the outlet side of the cartridge serves as a passage and possibly for a fine adjustment of the mixer drive shaft. Also, toothed belt drive 9 of mixer drive shaft 5 is forcibly pivoted at the same time.

Although in the present example, the small distance between the cartridge containers allows the passage of the mixer drive shaft, there is no space for its drive. Therefore, the drive is located in the rear of the dispenser outside the cartridge and slide area.

It is understood that in the same manner as described here for cross-sectional ratios of 1:1 and 5:1, the dispensers can be dimensioned for any other ratios as well. For example, if a ratio of 2:1 were required, a different cartridge tray or two guide strips, and corresponding spacers would be necessary while the remaining parts of the dispenser would be identical to the represented 1:1/5:1 dispenser.

In the present examples, double cartridges have been described which must be discarded after use. The same dispenser with the same parts can alternatively be used for supporting cartridges containing tubular bags, the supporting cartridges comprising the same spacers as the double cartridges.

What is claimed is:

1. A cartridge dispenser comprising:

a housing base configured to receive a first double cartridge having two containers or a second double cartridge having two containers, the containers of the first cartridge having a cross-section different than a cross-section of the containers of the second cartridge, wherein the housing base includes a locating means, and each of said first and second double cartridges include a respective locating means;

wherein at least one of said locating means in the housing base and said locating means of the first and second double cartridges allow correct retaining positions of double cartridges having containers of different cross-sectional ratios of preferably 1:1 to 10:1;

wherein said locating means for said first and second double cartridges include a cartridge tray adapted to the diameters of said containers which is fastened to said housing base, the cartridge tray including tray contours having different curvature radii, one of which corresponds to a curvature radius of a container having a smallest cross-sectional ratio of the cartridges, while another of which corresponds to a curvature radius of a container having a greatest cross-sectional ratio of the cartridges.

2. The cartridge dispenser of claim 1, wherein the containers of said first double cartridge have equal cross-sectional area.

3. The cartridge dispenser of claim 1, wherein the containers of said first double cartridge have different cross-section areas.

4. The cartridge dispenser of claim 1, wherein said containers of said first double cartridge are attached in pairs.

5. A cartridge dispenser comprising:

a housing base adapted to receive at least two double cartridges, each of said at least two double cartridges having a first container and a second container of different size than containers in the other of said at least two double cartridges, said first container and said second container having equal or different cross-sectional areas with respect to each other;

a first plunger for dispensing a first substance from said first container;

a second plunger for dispensing a second substance from said second container;

a mixer for mixing said first substance with second substance; and a driver for the mixer and a corresponding mixer drive shaft, wherein said mixer drive shaft is supported such that it is positioned by the insertion of said first container and said second container, at least one of said containers acting upon said mixer drive shaft via said driver, wherein the distance between the axes of said first plunger and said second plunger is the same for all containers irrespective of different cross-sectional areas.

6. The dispenser of claim 5, wherein said mixer is located on an axis which extends between the imaginary prolongation of said containers and on or near the connecting line between an outlet of said first container and an outlet of said second container.

7. The dispenser of claim 5, further comprising a displaceable mixer driver shaft engaging said mixer.

* * * * *